US008141713B2

(12) United States Patent
Farkas et al.

(10) Patent No.: US 8,141,713 B2
(45) Date of Patent: Mar. 27, 2012

(54) CONTAINER WITH PULL-OUT COMPARTMENTS

(75) Inventors: Scott Farkas, Fremont, WI (US); Doug Dewhurst, Berlin, WI (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 12/887,112

(22) Filed: Sep. 21, 2010

(65) Prior Publication Data

US 2011/0080074 A1 Apr. 7, 2011

Related U.S. Application Data

(60) Provisional application No. 61/247,743, filed on Oct. 1, 2009.

(51) Int. Cl.
*B65D 5/00* (2006.01)

(52) U.S. Cl. ..... 206/762; 206/766; 229/121; 229/160.1

(58) Field of Classification Search ..... 229/121, 229/122, 120.38, 160.1, 125.09, 125.08; 206/736, 737, 751, 756, 757, 759, 760, 762, 206/766

See application file for complete search history.

(56) References Cited

U.S. PATENT DOCUMENTS

| | | | | |
|---|---|---|---|---|
| 1,827,008 | A | 10/1931 | Huckel | |
| 1,912,847 | A | 6/1933 | Earl | |
| 1,992,373 | A * | 2/1935 | Johnson | 206/268 |
| D104,437 | S | 5/1937 | Bulman | |
| 2,339,656 | A * | 1/1944 | Shina | 229/231 |
| D146,386 | S | 2/1947 | Shield | |
| D153,188 | S | 3/1949 | Stensgaard | |
| D158,775 | S | 5/1950 | Malkin | |
| D158,776 | S | 5/1950 | Malkin | |
| 2,706,066 | A * | 4/1955 | Wells | 221/92 |
| 2,798,685 | A | 7/1957 | Severn | |
| 2,944,555 | A * | 7/1960 | Peel et al. | 131/238 |
| 2,975,890 | A * | 3/1961 | Block | 206/92 |
| 3,026,015 | A | 3/1962 | Simkins | |
| 3,058,646 | A * | 10/1962 | Reynolds | 229/160.1 |
| 3,161,341 | A * | 12/1964 | Farquhar | 229/122.1 |
| D204,434 | S | 4/1966 | Kingsford | |
| 3,480,196 | A | 11/1969 | Simas | |
| 3,690,118 | A | 9/1972 | Rainwater | |
| 3,696,990 | A * | 10/1972 | Dewhurst | 206/427 |
| 3,730,417 | A | 5/1973 | Lawson | |

(Continued)

FOREIGN PATENT DOCUMENTS

EP 0629557 A1 12/1994

(Continued)

OTHER PUBLICATIONS

LeBlanc, Rick; "Limits on Export Pallets Creating Corrugated Window of Opportunity; Corrugated Pallet Suppliers Experiencing Renewed Interest for Export, Domestic Markets"; http://www.palletenterprise.com/articledatabase/view.asp?articleID=648; 7 pages; Apr. 1, 2002.

(Continued)

*Primary Examiner* — Jacob K Ackun
(74) *Attorney, Agent, or Firm* — Ungaretti & Harris LLP

(57) ABSTRACT

A container formed from a corrugated material having a first lower compartment and a second upper compartment. The container having a lower pull-out panel for accessing the lower compartment, and an upper pull-out panel for accessing the upper compartment.

16 Claims, 14 Drawing Sheets

U.S. PATENT DOCUMENTS 3,879,053 A 4/1975 Chvala
3,886,348 A 5/1975 Jonathan et al.
3,944,128 A * 3/1976 Hogan ..... 229/221
D239,805 S 5/1976 South
4,004,691 A * 1/1977 Wihksne ..... 206/459.1
D244,117 S 4/1977 Naylor
4,085,847 A 4/1978 Jacalone
4,099,813 A 7/1978 Olivan
4,171,741 A 10/1979 Fish
4,283,000 A * 8/1981 White ..... 221/312 R
4,375,874 A 3/1983 Leotta et al.
4,376,558 A * 3/1983 Bandar ..... 312/259
4,503,973 A 3/1985 Andersson
D278,493 S 4/1985 Brescia et al.
4,602,735 A * 7/1986 Aaron ..... 229/122.1
4,610,355 A 9/1986 Maurer
4,658,984 A * 4/1987 Brunner ..... 221/64
D292,659 S 11/1987 Svezia et al.
D293,520 S 1/1988 Ovitz, III
4,722,473 A * 2/1988 Sandrini et al. ..... 229/117.01
D294,908 S 3/1988 Childress
4,765,492 A 8/1988 Howard et al.
4,793,664 A 12/1988 Jackson
4,826,265 A 5/1989 Hockenberry
4,850,284 A 7/1989 DeGroot et al.
4,852,756 A 8/1989 Holladay
4,863,024 A 9/1989 Booth
4,877,137 A 10/1989 Govang et al.
4,911,084 A 3/1990 Sato et al.
4,936,470 A 6/1990 Prindle
D321,100 S 10/1991 Dorrell
D321,295 S 11/1991 Nuebler
D321,615 S 11/1991 Lavine et al.
5,067,418 A 11/1991 Carter
5,119,740 A 6/1992 Carter
5,176,265 A 1/1993 Bennett
D332,883 S 2/1993 Staude
5,195,440 A 3/1993 Gottlieb
5,259,631 A * 11/1993 Brande ..... 229/121
5,269,219 A 12/1993 Juvik-Woods
5,272,990 A 12/1993 Carter
D349,202 S 8/1994 Eliadis et al.
D351,076 S 10/1994 Eliadis et al.
5,357,875 A 10/1994 Winebarger et al.
5,388,531 A 2/1995 Crews et al.
5,413,053 A 5/1995 Vannatta
5,427,019 A 6/1995 Moorman
D363,840 S 11/1995 Weshler
5,465,672 A 11/1995 Boyse et al.
5,487,344 A 1/1996 Hutchison
D369,035 S 4/1996 Potter
D369,043 S 4/1996 Parker
5,520,120 A 5/1996 Badger
5,528,994 A 6/1996 Iseli
5,540,536 A 7/1996 Hoedl
5,543,205 A 8/1996 Liebel
5,590,606 A 1/1997 Crews et al.
5,603,258 A 2/1997 Besaw
5,622,306 A 4/1997 Grigsby et al.
5,672,412 A 9/1997 Phares et al.
5,685,234 A 11/1997 Grigsby et al.
D388,905 S 1/1998 Wells
5,706,953 A 1/1998 Polvere
5,711,423 A 1/1998 Fuller, Jr.
D395,534 S 6/1998 Besaw
5,762,213 A 6/1998 Heneveld, Sr.
5,794,542 A 8/1998 Besaw
5,797,499 A 8/1998 Pinco
D398,461 S 9/1998 Baluk et al.
D398,462 S 9/1998 Baluk et al.
5,809,903 A 9/1998 Young, Jr.
5,816,172 A 10/1998 Carter
5,832,841 A 11/1998 Crews et al.
5,881,652 A 3/1999 Besaw
D412,253 S 7/1999 Brozak, Jr.
5,918,744 A 7/1999 Bringard et al.
5,980,008 A 11/1999 Stoever
5,996,366 A 12/1999 Renard
5,996,510 A 12/1999 Harpman et al.
D419,275 S 1/2000 Carter
D419,744 S 1/2000 Carter
6,012,399 A 1/2000 Carter
6,070,726 A 6/2000 Graham
6,076,475 A 6/2000 Kuhn et al.
D428,738 S 8/2000 Brozak, Jr.
6,126,131 A 10/2000 Tietz
6,135,030 A 10/2000 Besaw
D433,782 S 11/2000 Carter
D433,839 S 11/2000 Culbertson
6,145,671 A 11/2000 Riga et al.
6,164,215 A 12/2000 Cook et al.
6,189,778 B1 * 2/2001 Kanter ..... 229/122.1
D453,057 S 1/2002 Sewell
6,354,229 B1 3/2002 Heidtke
6,394,003 B1 5/2002 Lacy, III
D461,334 S 8/2002 Johnson et al.
D464,498 S 10/2002 Riga et al.
6,585,118 B2 7/2003 Kellogg
6,612,247 B1 9/2003 Pistner et al.
6,659,295 B1 12/2003 De Land et al.
6,729,484 B2 5/2004 Sparkowski
6,769,368 B2 8/2004 Underbrink et al.
D495,901 S 9/2004 Bosman
6,814,245 B2 11/2004 Leclerc et al.
6,905,021 B2 6/2005 Polumbaum et al.
D509,382 S 9/2005 Raile
6,951,300 B2 * 10/2005 Caille et al. ..... 229/121
D521,275 S 5/2006 Dusenberry
7,036,196 B2 5/2006 Salatin et al.
7,066,380 B2 * 6/2006 Blake ..... 229/122.1
7,089,872 B2 * 8/2006 Wintermute et al. ..... 108/165
D533,734 S 12/2006 Campbell
7,191,906 B1 3/2007 Pinco
D566,989 S 4/2008 Mason
D576,426 S 9/2008 Yuen-Schat et al.
D578,804 S 10/2008 Norman et al.
7,546,926 B2 6/2009 Stolle et al.
D603,189 S 11/2009 Raile
7,650,996 B2 1/2010 Mark
7,703,665 B2 * 4/2010 McGowan ..... 229/122.1
7,828,169 B2 11/2010 Robinson et al.
8,002,171 B2 * 8/2011 Ryan et al. ..... 229/122
2003/0042828 A1 3/2003 Bonin
2005/0252872 A1 11/2005 Eisele
2008/0087562 A1 * 4/2008 Berger et al. ..... 206/268
2008/0197182 A1 * 8/2008 Jackson ..... 229/247
2009/0107940 A1 4/2009 Norman et al.

FOREIGN PATENT DOCUMENTS

JP 06278746 10/1994

OTHER PUBLICATIONS

"Solid Wood Packing Materials to Argentina"; http://www.corrugatedprices.com/pallets/swang.html; 2 pages; Feb. 5, 2002.

* cited by examiner

CONTAINER WITH PULL-OUT COMPARTMENTS

CROSS-REFERENCE TO RELATED APPLICATIONS

The present application claims the benefit of U.S. Provisional Patent Application No. 61/247,743 filed Oct. 1, 2009, the contents of which are incorporated herein by reference.

FEDERALLY SPONSORED RESEARCH OR DEVELOPMENT

N/A

FIELD OF THE INVENTION

The present invention generally relates to a container formed from a corrugated material having a plurality of pull-out compartments for storing goods.

BACKGROUND OF THE INVENTION

A variety of systems are used to transport and/or display merchandise. Some of these systems can be costly and difficult to manufacture, ship or set up on site.

The present invention provides an embodiment of a corrugated shelving display system that overcomes the problems of prior display systems.

SUMMARY OF THE INVENTION

The present invention provides a container having three components made from paper products, such as paperboard or a corrugated material like cardboard. The container is generally rectangular with a plurality of compartments for storing and displaying goods. The compartments are accessed by front panels or doors that pull-out from a front wall of the container. The pull-out panels are pivotally connected to the front wall along a bottom edge.

The first component forms the front, back and side walls of the container, and includes flaps for forming a top wall and bottom wall. The second component is glued to the inside of the front wall to provide side panels for the pull-out panels. The third component is glued to the inside of the back wall and includes a divider wall for separating the compartments, and a support panel for supporting the divider panel.

In accordance with one embodiment of the invention, a container with pull-out compartment panels is shown. The container comprises a first component having a bottom wall, a back wall, a first side wall, a second side wall and a front wall. The front wall includes a first lower opening panel, and a second upper opening panel. A first compartment is formed in a lower portion of the container and the first lower opening panel in the front wall provides access to the first lower compartment. A second compartment is formed in an upper portion of the container and the second upper opening panel in the front wall provides access to the second upper compartment. A divider panel separates the first compartment from the second compartment.

A second component is connected to an interior surface of the front wall. The second component provides a first side panel and a second side panel which extend from the first lower panel opening when the lower compartment is opened, and a first side panel and a second side panel which extend from the second upper panel opening when the upper compartment is opened. The side panels prevent goods stored in the compartments from spilling out upon opening the first and second opening panels.

The first side panel which extends from the first lower panel opening, includes a projection or stop for limiting movement of the first lower panel opening. Similarly, the first side panel which extends from the second upper panel opening includes a projection or stop for limiting movement of the second upper panel opening. Additionally, the second side panels can also include projections for limiting movement of the panel openings.

Each of the first and second side panels which extend from the first lower panel opening, and the first and second side panels that extend from the second upper panel opening have an arcuate or curved upper edge. The arcuate upper edge follows the path of the upper edge of the panel openings when opened.

The container includes a third component having a first panel connected to an interior surface of the back wall of the container. The third component also includes the divider panel which is connected to the first panel. The divider panel is folded into position separating the lower compartment and the upper compartment.

The third component also includes a support panel connected to the first panel. The support panel is folded toward the front wall and provides support to the divider panel. The support panel includes a panel or flap that can be glued to the front wall.

The first component, the second component and the third component are each preferably formed from a corrugated material, such as cardboard.

The second component and the third component are preferably glued to the first component.

In accordance with another embodiment of the invention, a container for transporting and displaying goods is provided. The container comprises a back wall, a first side wall integrally connected to a first side of the back wall, a front wall, and a second side wall. The front wall includes a first opening panel cut-out from the front wall along a top edge, a first side edge and a second side edge, and is hingedly connected to the front wall at a lower edge. The first opening panel provides access to a first compartment formed in the container. The back wall, first and second side walls and front wall are formed from a single blank of material.

The container further comprises a second opening panel cut-out from the front wall along a top edge, a first side edge and a second side edge, and is hingedly connected to the front wall at a lower edge. The second opening panel provides access to a second compartment formed in the container.

The container further comprises a first side panel extending from a first side of the first opening panel and a second side panel extending from a second side of the first opening panel. The container can also comprise a first side panel extending from a first side of the second opening panel and a second side panel extending from a second side of the second opening panel.

The first side panels and the second side panels can include an arcuate upper edge. One or more of the first and second side panels can also include a projection along the arcuate edge to prevent the opening panels from opening beyond the projection. The projection hits a portion of the interior surface of the front wall as the opening panel is opened to prevent further movement outward.

The first and second side panels of the first and second opening panels are part of a second blank of material glued to an interior surface of the first blank of material. Alternatively, the second blank of material can be split into two pieces, one for the first compartment and front opening panel and a separate one for the second compartment and second opening panel.

The container can further comprise a divider panel separating the first compartment and the second compartment. The divider panel is part of a third blank of material having a back panel connected to the back wall, a front panel connected to the front wall and a support panel therebetween. The back and front panels are glued in place.

Other features and advantages of the invention will be apparent from the following specification taken in conjunction with the following Figures.

BRIEF DESCRIPTION OF THE FIGURES

To understand the present invention, it will now be described by way of example, with reference to the accompanying Figures in which.

DETAILED DESCRIPTION OF THE INVENTION

While this invention is susceptible of embodiments in many different forms, there is shown in the Figures and will herein be described in detail preferred embodiments of the invention with the understanding that the present disclosure is to be considered as an exemplification of the principles of the invention and is not intended to limit the broad aspect of the invention to the embodiments illustrated.

Figure 1:
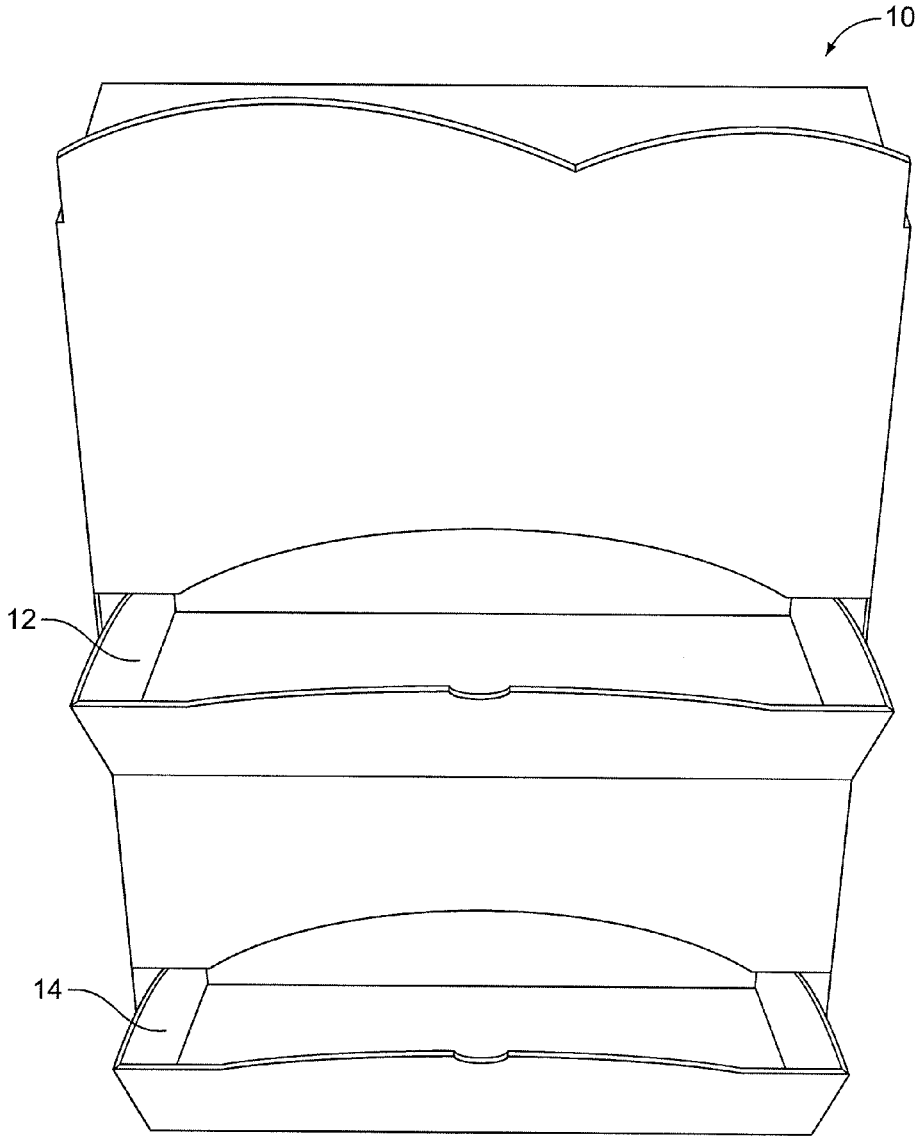
FIG. 1 is a perspective view of a container having pull-out storage compartments in accordance with the present invention.

A container 10 having an upper pull-out compartment 12 and a lower pull-out compartment 14 for storing goods is shown in FIG. 1. The container 10 can be formed from paper or cardboard, or other similar materials. In particular, the container can be a corrugated material. The container 10 can be several component pieces glued and folded together. While the container 10 is shown with two pull-out compartments, containers having just one compartment, or more than two can be made in accordance with the teachings herein.

Figure 2:
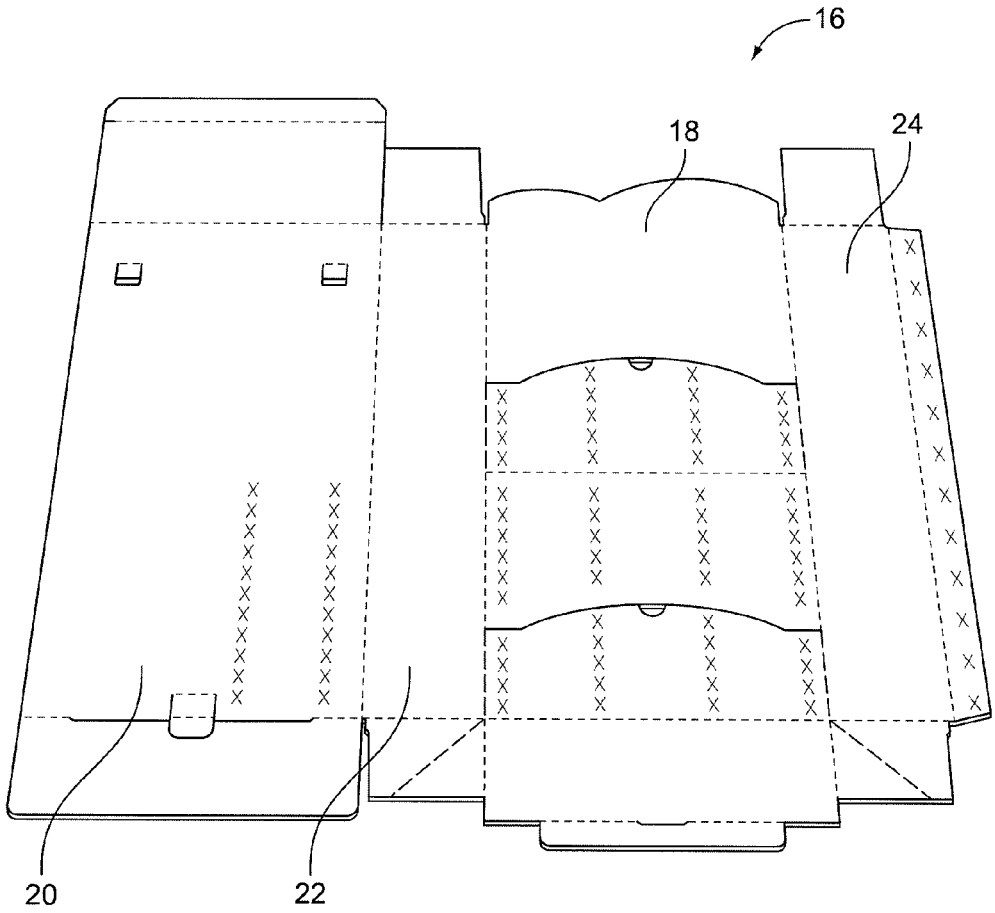
FIG. 2 is a plan view of a first component in an open format that can be utilized for forming a portion of the container of FIG. 1.

Referring to FIG. 2, a first component 16 for forming the container 10 is shown. The first component 16 forms the outer walls of the container 10 and is shown opened in an unfolded state with the interior (when set-up) of the container 10 exposed. The first component 16 includes a front wall 18, a back wall 20 and a first side wall 22 and second side wall 24. Additionally, flaps extending from the ends of one or more of the front wall, back wall and side walls are provided for forming a bottom portion and a top portion of the container 10.

Figure 3:
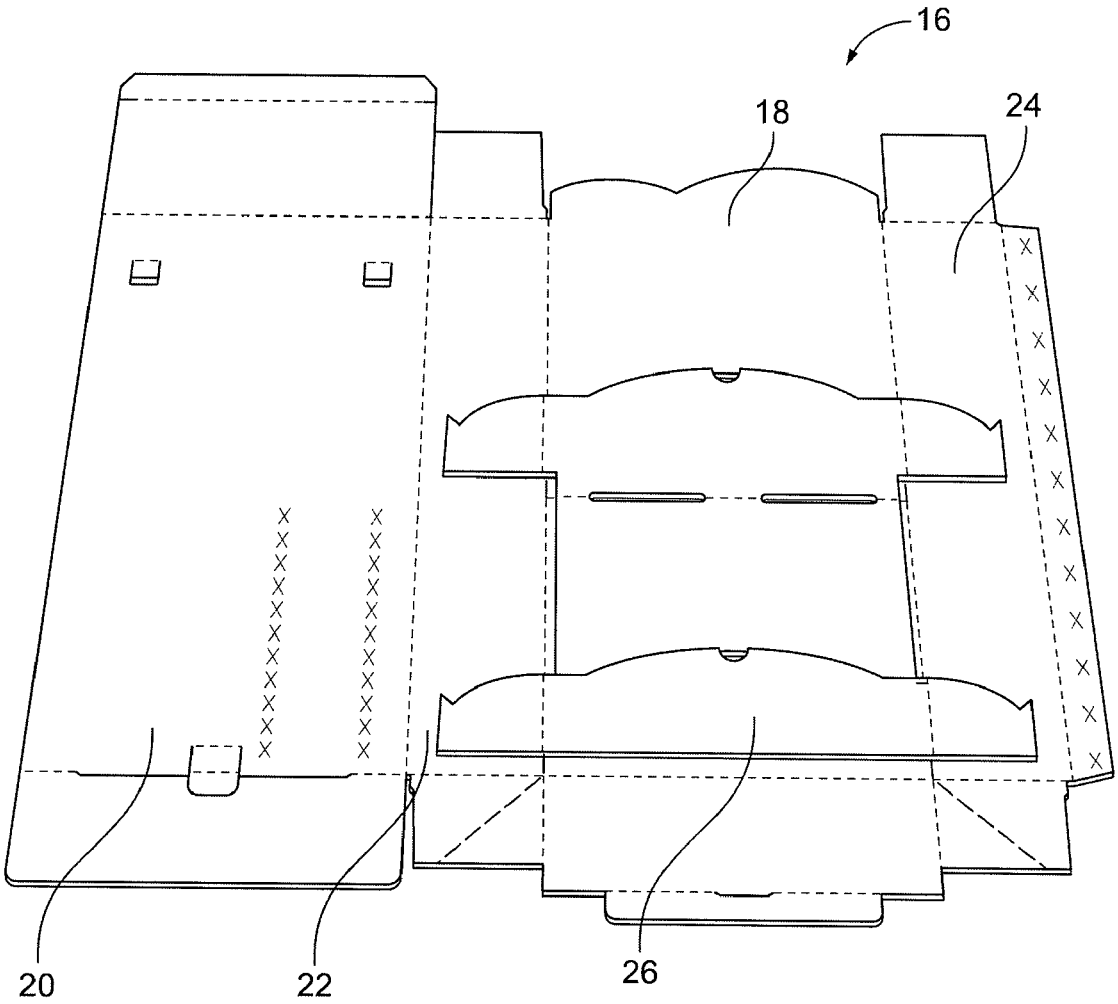
FIG. 3 is a plan view the first component of FIG. 2 with a second component of the compartment positioned on the first component.

FIG. 3 shows a second component 26 for forming the container 10 glued to the interior surface of the front wall 18 of the first component 16. The second component 26 enables the container to include an upper pull-out compartment and a lower pull-out compartment as described below.

Figure 4:
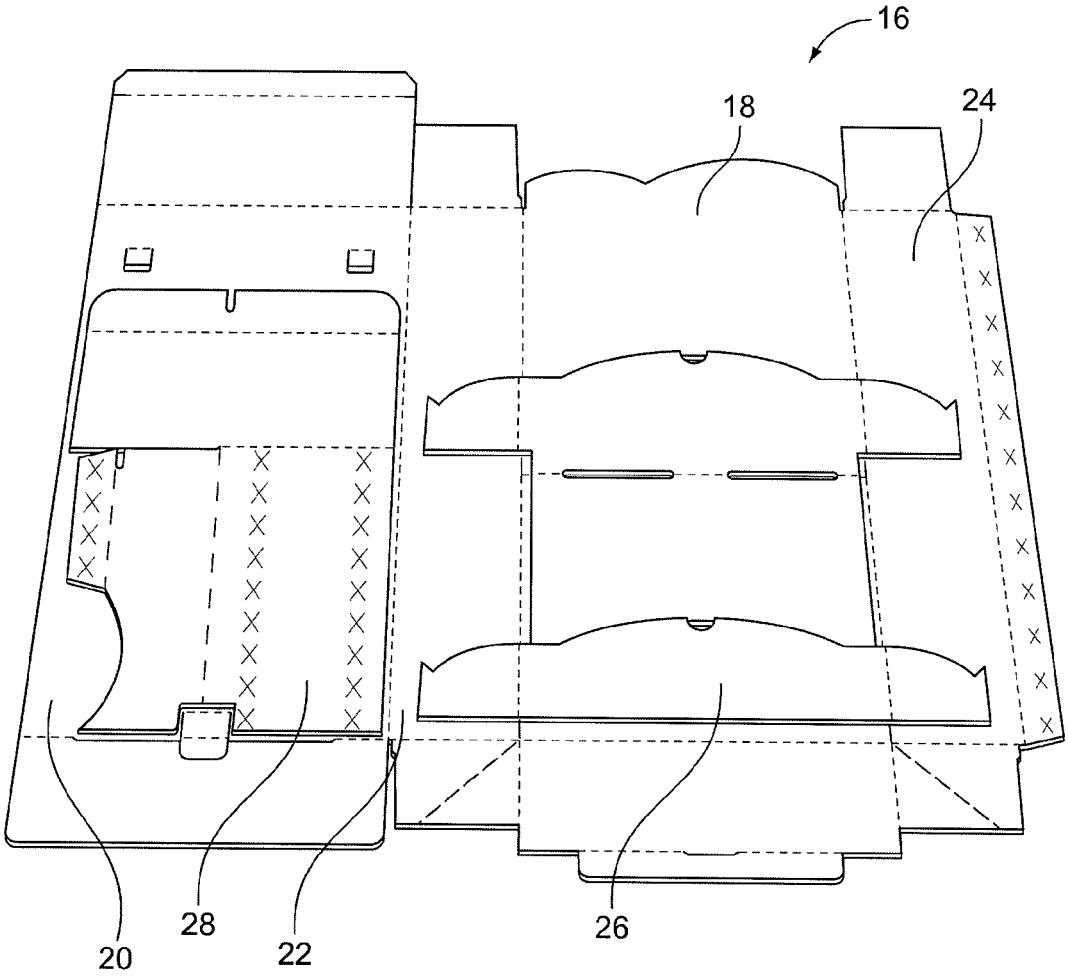
FIG. 4 is a plan view of a side of the first component of FIG. 2 with a third component of the compartment positioned on the first component.

FIG. 4 shows a third component 28 for forming the container 10 glued to the back wall 20 of the first component 16. The third component 28 provides a divider wall which splits the upper pull-out compartment and the lower pull-out compartment as described below. Each of the three components is cut to the appropriate respective shape, and includes fold and/or tear lines as necessary to create the finished container 10.

Figure 5:
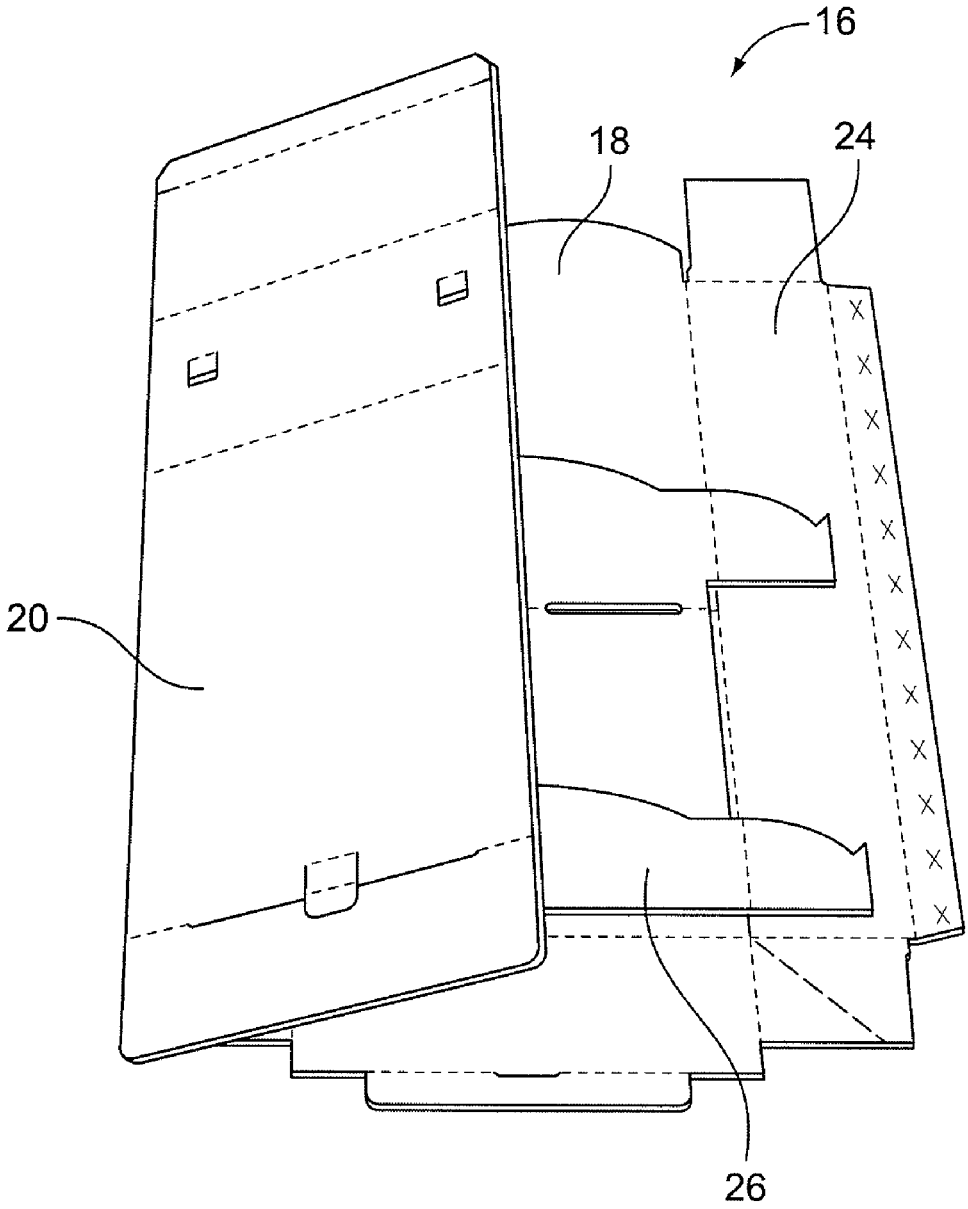
FIG. 5 is a perspective view of the first component, second component and third component partially folded into the container configuration.
Figure 6:
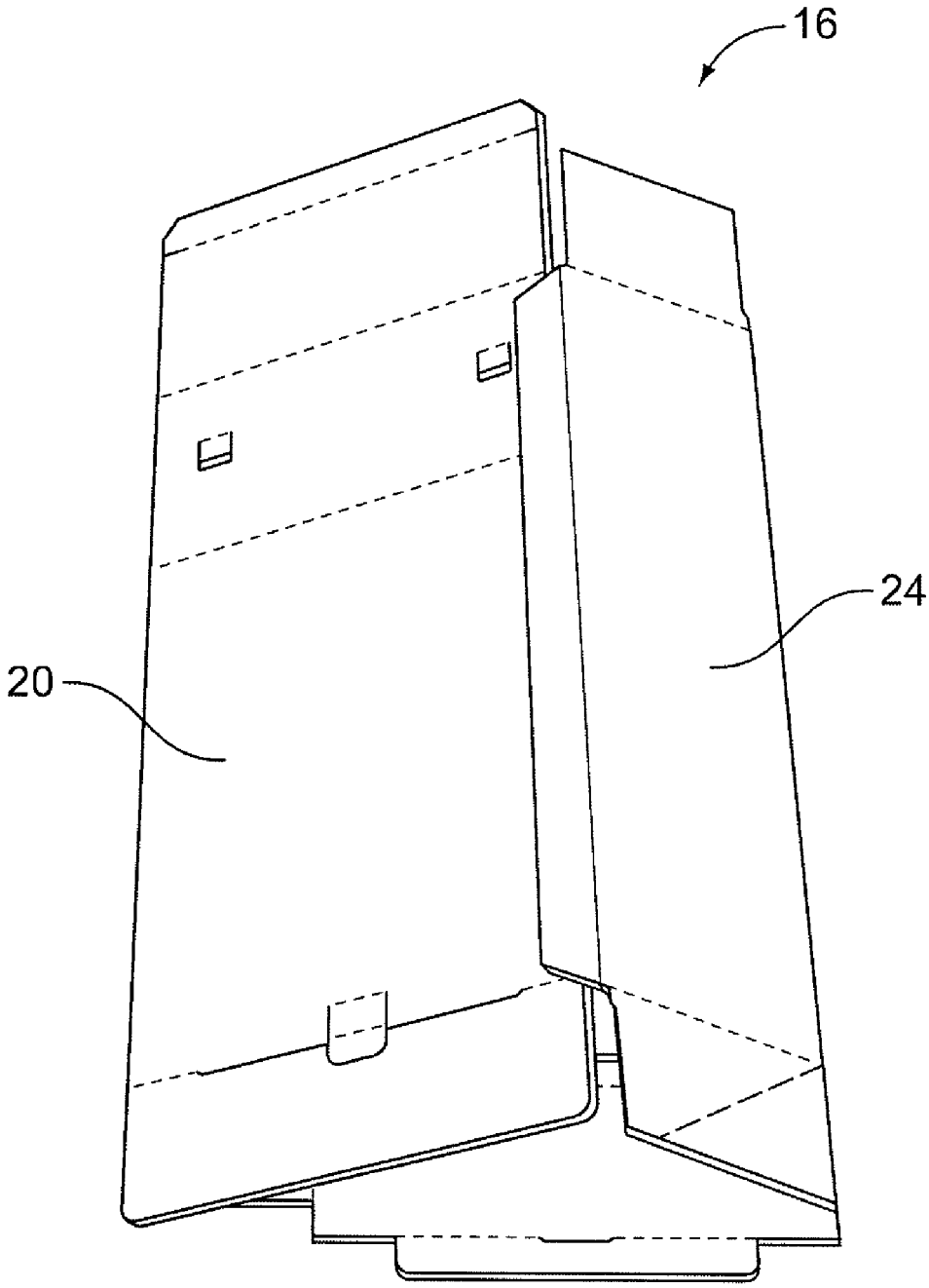
FIG. 6 is a perspective view of the first component, second component and third component further partially folded into the container configuration.

FIGS. 5-10 show, in progression, the steps of folding the first, second and third components 16, 26 and 28 to form the container 10. In FIG. 5, the first side wall 22 and back wall 20 are folded upward. FIG. 6 shows the second side wall 24 folded to meet the back wall 20.

Figure 7:
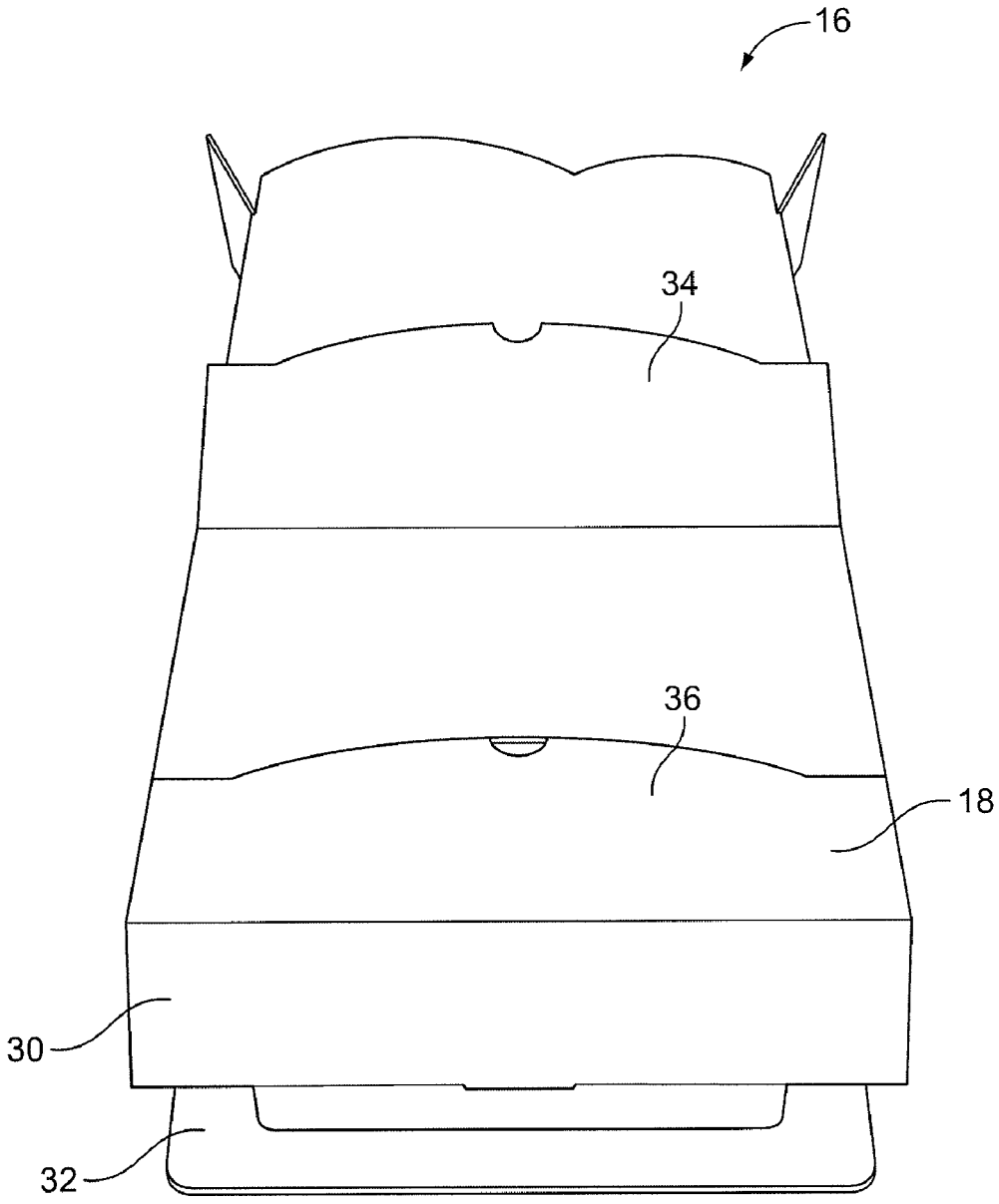
FIG. 7 is a perspective view of a lower portion of the first component, second component and third component further partially folded into the container configuration.
Figure 8:
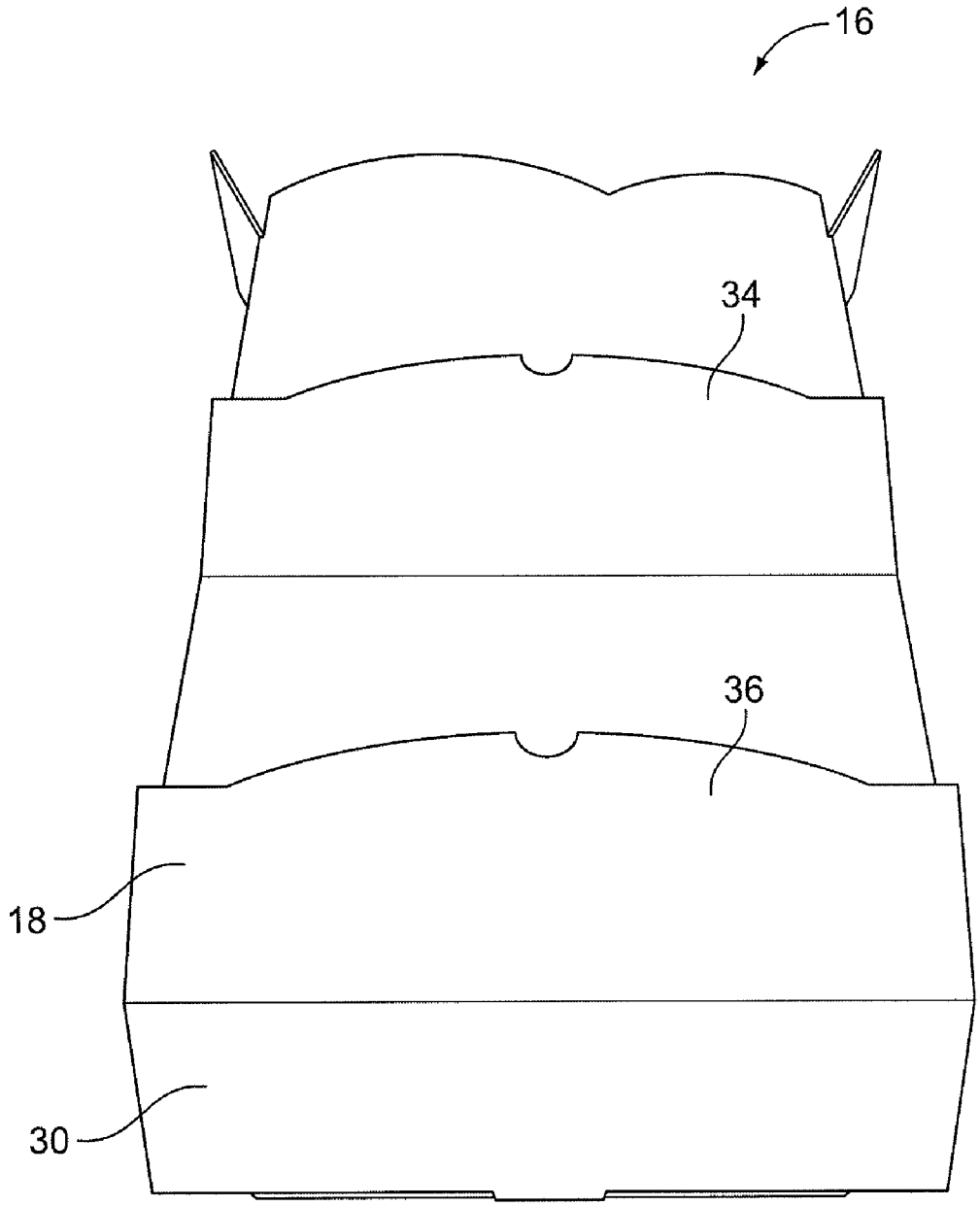
FIG. 8 is a perspective view of the lower portion of the container with the bottom folded.

FIG. 7 shows the front wall 18 with bottom flaps 30, 32 in an open position. Also shown in FIG. 7 is a front panel or door 34 for a first, upper compartment and a front panel or door 36 for a second, lower compartment. The front panels 34, 36 are hingedly connected to the front wall 18 and can be pulled out from the front wall 18 to allow access to the upper and lower compartments, respectively. FIG. 8 shows the container 10 with the bottom flaps 30, 32 closed.

Figure 9:
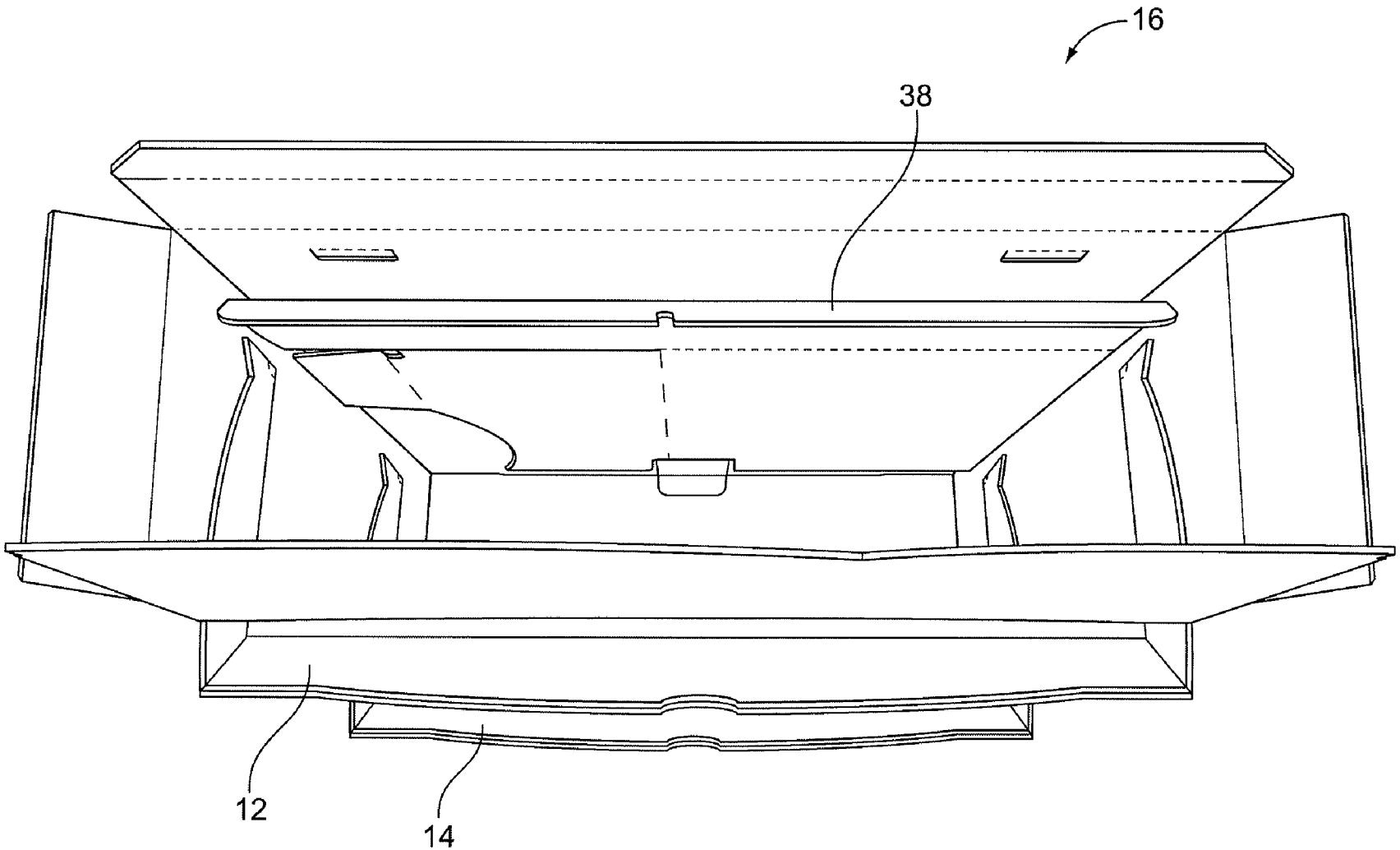
FIG. 9 is a top perspective view showing the interior of the container with a first and second compartment door in a partially open position.
Figure 10:
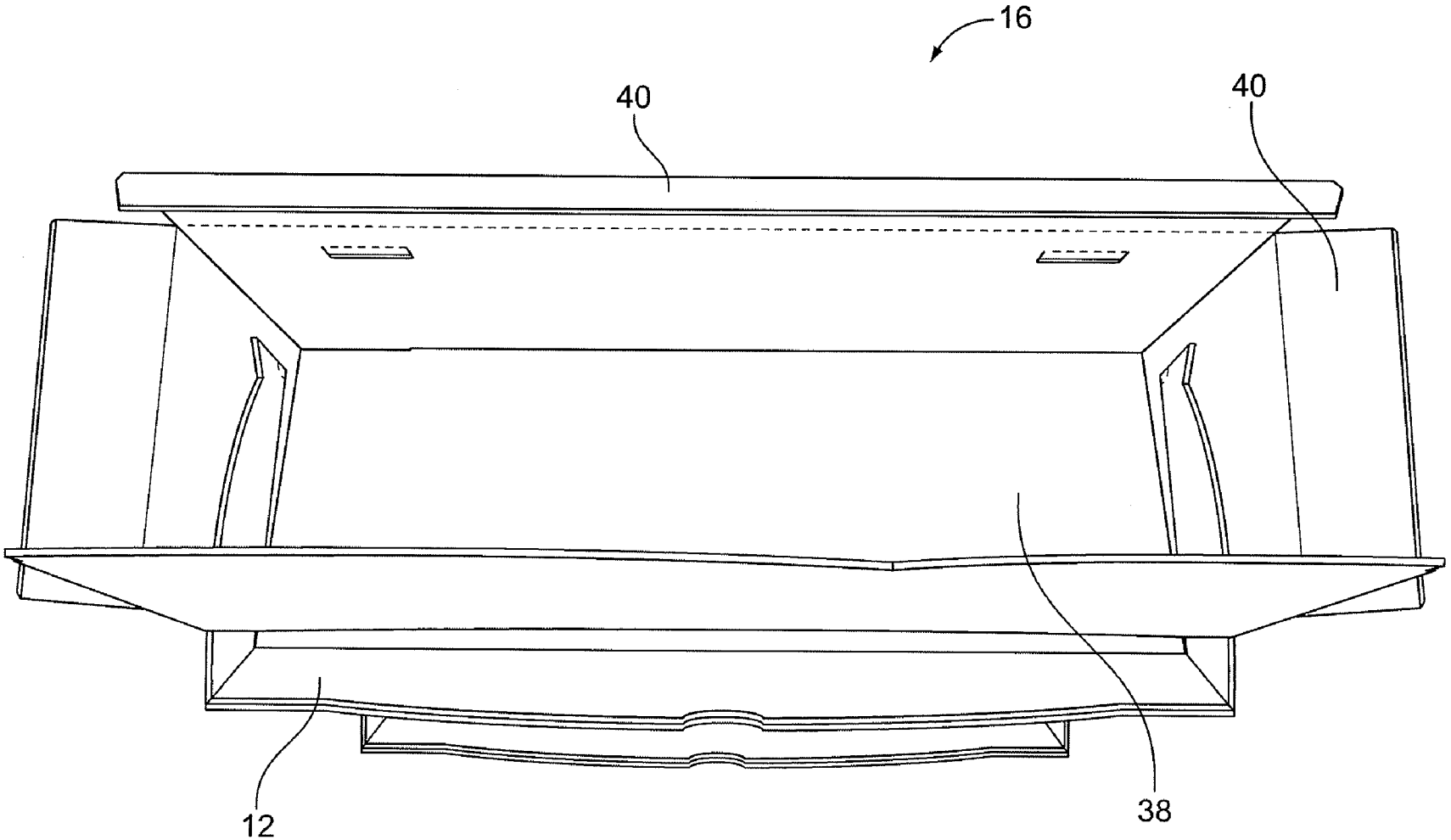
FIG. 10 is a top perspective view of the interior of the container from a top view showing a divider element.

FIG. 9 shows the interior of the container 10 from a top down view. In this view, the divider panel 38 of the third component 28 is shown in an open position. FIG. 10 shows the divider panel 38 closed to separate the lower compartment 14 from the upper compartment 12.

The container 10 includes upper flaps 40 for forming a top. The flaps 40 are folded in a conventional manner to form the top.

Figure 11:
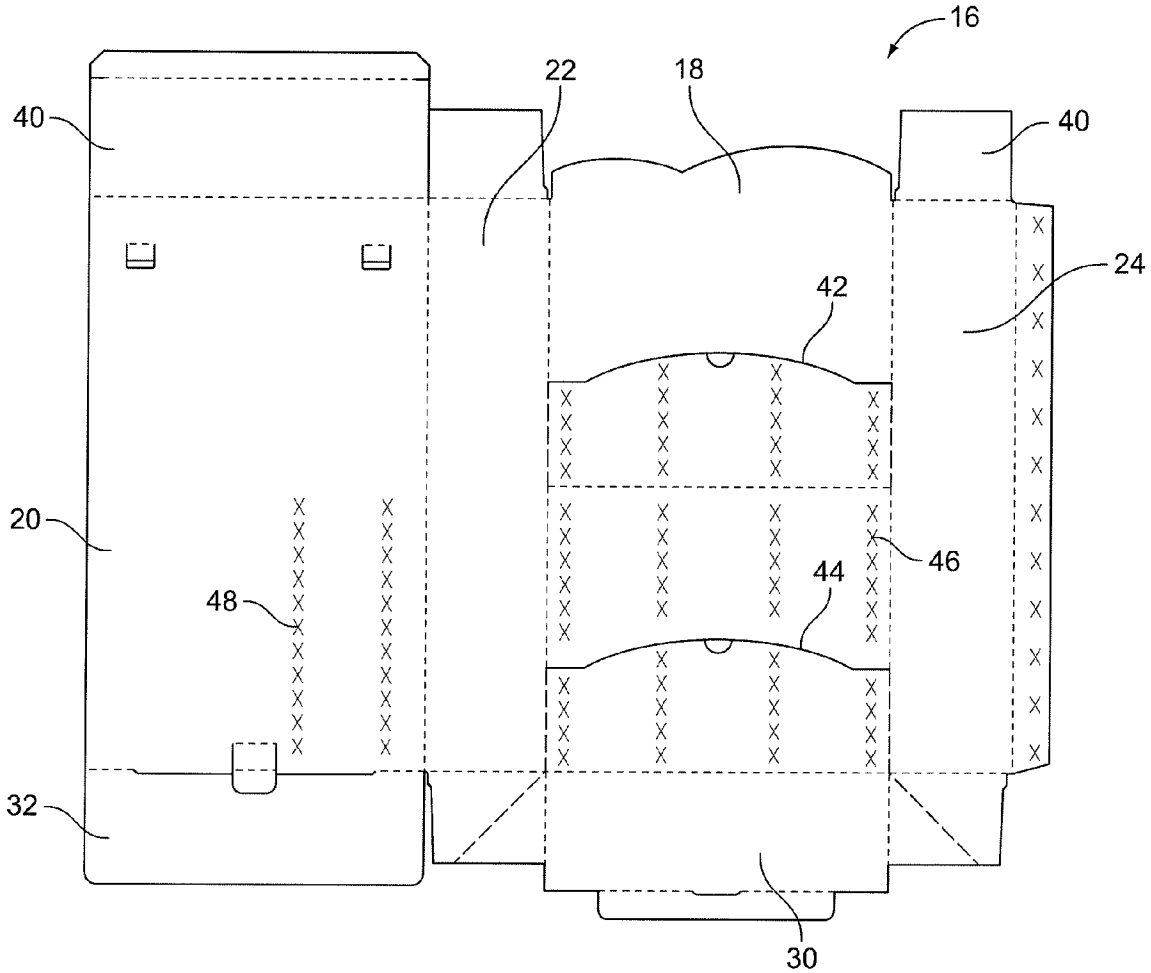
FIG. 11 is a blank of the first component.
Figure 12:
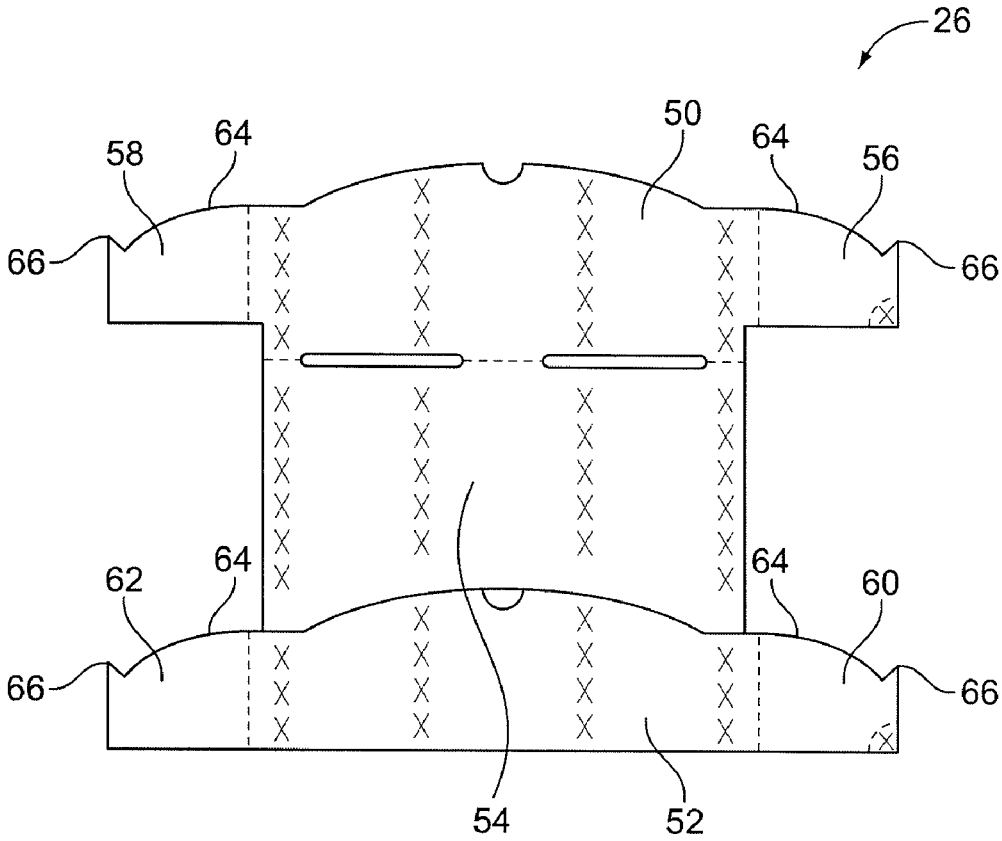
FIG. 12 is a blank of the second component.
Figure 13:
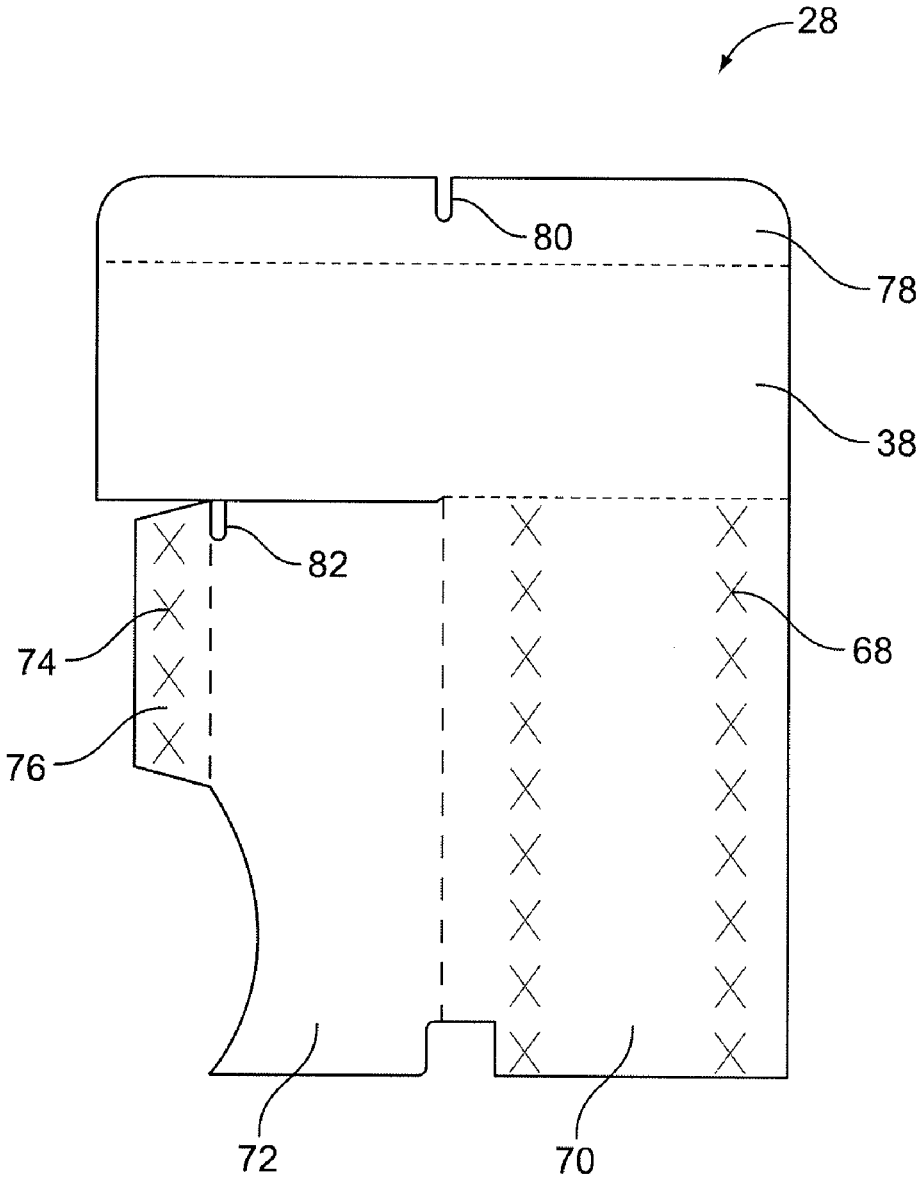
FIG. 13 is a blank of the third component.
Figure 14:
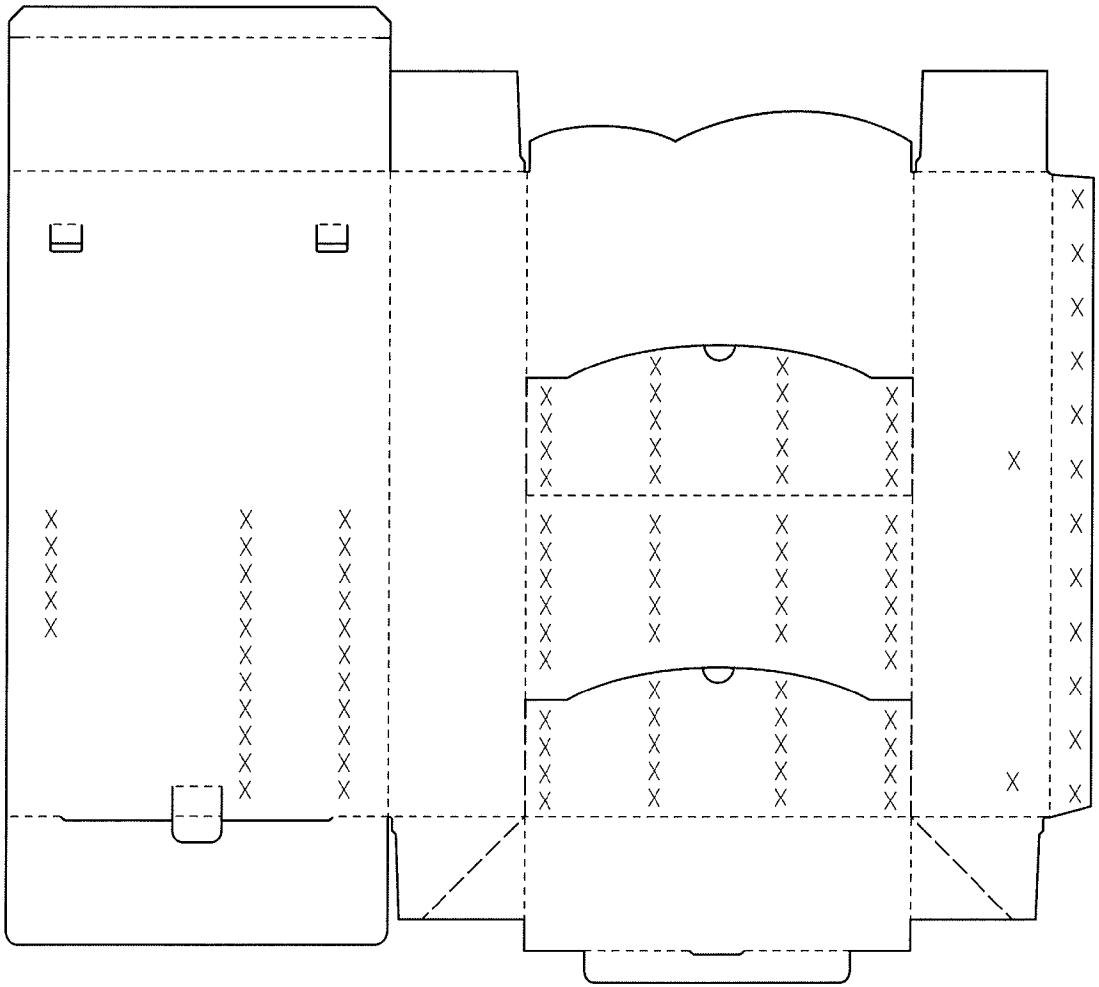
FIG. 14 is a blank of a modified first component.

FIGS. 11-13 show blanks for forming the first, second and third components 16, 26 and 28 of the container 10. FIG. 14 shows all three blanks together (with the second and third blanks drawn in lightly).

The blank 16 in FIG. 11, which forms the outer walls of the container 10, is shown open with the interior side visible. The front wall 18 includes an upper front panel 34 which is cut-out from the front wall 18 along a top and sides, and is pivotally connected to the front wall 18 by a lower fold line. The upper front panel 34 includes an upper slightly arcuate edge 42. The front panel 34 forms the outer wall or opening panel of the upper compartment. The front wall 18 also includes a lower front panel 36 which is similarly cut-out from the front wall 18 and includes an upper slightly arcuate upper edge 44. The lower front panel 36 forms the outer wall or opening panel of the lower compartment. Both the upper front panel 34 and the lower front panel 36 remain pivotally connected to the front wall 18 by a lower edge.

The front wall 18 of the first component 16 includes a first glue region illustrated by a plurality of "x's"46. The second component 26 is glued to the first glue region of the first component 16.

The back wall 20 of the first component 16 includes a second glue region illustrated by a plurality of "x's" 48. The third component 28 is glued to the second glue region of the first component 16.

Referring to FIG. 12, the second component 26 includes an upper panel 50 that corresponds to the upper front panel 34 of the front wall 18, and a lower panel 52 that corresponds to the lower front panel 36 of the front wall 18. The second component 26 also includes a central portion 54. The central portion 54 corresponds to a portion of the front wall 18 between the upper front panel 34 and the lower front panel 36.

The upper panel 50 of the second component also includes a first side panel 56 and a second side panel 58. Similarly, the lower panel 52 also includes a first side panel 60 and a second side panel 62.

The first and second side panels 56,58,60,62 form the sides of the pull-out compartments. Each side panel includes an arcuate upper edge portion 64 and a projection 66 at the end of the side panel. The arcuate portion 64 facilitates opening of the compartment. Because each of the front panels 34,36 are hingedly connected to the front wall 18 at a lower edge, the upper edges 42,44 will travel along an arcuate path. Accordingly, as each front panel 34,36 is pulled out (along with the corresponding panels 50,52 of the second component 26), the arcuate portions 64 of the side panels 56,58,60,62 pull out along the same path as the upper edges 42,44. The projections 66 prevent the panels from moving completely out of the container 10.

Referring to FIG. 13, the third component 28 includes a first glue region 68 on a first lower panel 70. A second, lower support panel 72 is connected on one side to the first lower panel by a fold line. A second glue region 74 is provided on a third panel 76 connected by a fold line on the other side of the second panel. The divider panel 38 having an upper fold-in portion 78 is connected above the first lower panel 70.

In operation, the first lower panel 70 is glued to the interior surface of the back wall 20 proximate the side wall 22. The second, lower support panel is folded toward the front wall 18 and the third panel is glued to an interior side of the second component 26. The divider panel 38 can then be folded downward onto the third panel 72. The upper fold-in portion 78 of the divider panel 38 includes a groove 80 that matches with a groove 82 in the third panel 72 to lock the divider panel in place.

In an alternative embodiment, the second component 26 can be configured to include a panel portion (possibly in the central portion 54) that is not glued to the front wall and folds back from the front wall to the back wall to form the divider. The panel portion can be a foldable tab at the end to be glued to the back wall. A perforated line can be utilized to disconnect the panel portion at one end from the remainder of the second component.

While the specific embodiments have been illustrated and described, numerous modifications come to mind without significantly departing from the spirit of the invention and the scope of protection is only limited by the scope of the accompanying Claims.

We claim:

1. A container with pull-out compartment panels comprising:

a first component formed from a single blank of material having a bottom wall, a back wall, a first side wall, a second side wall and a front wall, the front wall including a first lower opening panel pivotally connected to the front wall, and a second upper opening panel pivotally connected to the front wall;

a second component having a first side panel and a second side panel for a first compartment formed in a lower portion of the container wherein the first lower opening panel in the front wall provides access to the first lower compartment;

the second component having a first side panel and a second side panel for a second compartment formed in an upper portion of the container wherein the second upper opening panel in the front wall provides access to the second upper compartment;

a third component formed from a single blank of material, the third component having a lower panel glued to the back wall of the first component, a support panel foldably connected to the lower panel and extending toward the front wall, and a glue panel connected to the support panel and glued to the front wall of the first component; and, the third component having a divider panel separating the first compartment from the second compartment.

2. The container of claim 1 wherein the second component is formed from a single blank of material and the first side panel and second side panel for the first compartment extend from the first lower opening panel when the first compartment is opened, and the first side panel and second side panel for the second compartment extend from the second upper opening panel when the second compartment is opened.

3. The container of claim 2 wherein the first side panel which extends from the first lower panel opening includes a projection for limiting movement of the first lower opening panel, and the first side panel which extends from the second upper opening panel includes a projection for limiting movement of the second upper opening panel.

4. The container of claim 2 wherein each of the first and second side panels which extend from the first lower opening panel, and the first and second side panels that extend from the second upper opening panel have an arcuate upper edge.

5. The container of claim 1 wherein the first component is formed from a corrugated material.

6. The container of claim 2 wherein the second component is formed from a corrugated material.

7. The container of claim 1 wherein the third component is formed from a corrugated material.

8. A container for transporting and displaying goods comprising:

a back wall, a first side wall integrally connected to a first side of the back wall, a front wall, and a second side wall, the front wall including a first opening panel cut-out from the front wall along a top edge, a first side edge and a second side edge, and hingedly connected to the front wall at a lower edge, wherein the first opening panel provides access to a first compartment formed in the container and a second opening panel cut-out from the front wall along a top edge, a first side edge and a second side edge, and hingedly connected to the front wall at a lower edge, wherein the second opening panel provides access to a second compartment in the container, an interior panel having a back panel connected to the back wall, a front panel connected to the front wall and a support panel therebetween, and wherein the back wall, first and second side walls and front wall are formed from a single blank of material.

9. The container of claim 8 wherein the back panel of the interior panel is glued to the back wall of the container.

10. The container of claim 8 further comprising a first side panel extending from a first side of the first opening panel and a second side panel extending from a second side of the first opening panel.

11. The container of claim 10 wherein the first side panel and the second side panel include an arcuate upper edge.

12. The container of claim 11 wherein the first side panel includes a projection along the arcuate edge to prevent the first opening panel from opening beyond the projection.

13. The container of claim 8 further comprising a first side panel extending from a first side of the first opening panel and a second side panel extending from a second side of the first opening panel, and a first side panel extending from a first side of the second opening panel and a second side panel extending from a second side of the second opening panel.

14. The container of claim 13 wherein the first and second side panels of the first and second opening panels are part of a second blank of material glued to an interior surface of the first blank of material.

15. The container of claim 14 further comprising a divider panel separating the first compartment and the second compartment.

16. The container of claim 15 wherein the divider panel is part of a third blank of material.

* * * * *